US007341077B2

(12) United States Patent
Sampers

(10) Patent No.: US 7,341,077 B2
(45) Date of Patent: Mar. 11, 2008

(54) METHOD FOR OPERATING A LOOM

(75) Inventor: Dirk Sampers, Oostvleteren (BE)

(73) Assignee: Picanol N.V., Ypres (BE)

( * ) Notice: Subject to any disclaimer, the term of this patent is extended or adjusted under 35 U.S.C. 154(b) by 0 days.

(21) Appl. No.: 10/553,323

(22) PCT Filed: Apr. 7, 2004

(86) PCT No.: PCT/EP2004/003703

§ 371 (c)(1),
(2), (4) Date: Oct. 17, 2005

(87) PCT Pub. No.: WO2004/092467

PCT Pub. Date: Oct. 28, 2004

(65) Prior Publication Data

US 2006/0207674 A1 Sep. 21, 2006

(30) Foreign Application Priority Data

Apr. 17, 2003 (DE) ..... 103 18 818
Apr. 17, 2003 (DE) ..... 103 18 819

(51) Int. Cl.
*D03D 51/00* (2006.01)
*D03D 51/02* (2006.01)
*D03D 51/28* (2006.01)
*D03C 13/00* (2006.01)

(52) U.S. Cl. ..... 139/55.1; 139/1 R; 139/1 E; 139/338; 139/99; 139/105; 700/140

(58) Field of Classification Search ..... 139/55.1
See application file for complete search history.

(56) References Cited

U.S. PATENT DOCUMENTS 2,096,659 A * 10/1937 Webster et al. ..... 139/33
4,392,515 A * 7/1983 Moessinger ..... 139/55.1
5,355,062 A * 10/1994 Takizawa et al. ..... 318/568.1
5,565,748 A * 10/1996 Takizawa et al. ..... 318/568.1
5,596,256 A * 1/1997 Takizawa et al. ..... 318/600
5,617,901 A 4/1997 Adriaen et al.

(Continued)

FOREIGN PATENT DOCUMENTS

EP 0 726 345 8/1996

(Continued)

OTHER PUBLICATIONS

Payette, "The Virtual Shaft Control Algorithm for Synchronized Motion Control", Jun. 1998, American Control Conference, entire document.*

*Primary Examiner*—Gary L. Welch
*Assistant Examiner*—Robert H Muromoto, Jr.
(74) *Attorney, Agent, or Firm*—Bacon & Thomas, PLLC

(57) ABSTRACT

A loom having a first drive motor (10), which for instance drives a batten (13), and having at least one second drive motor (44), which drives a dobby (46), is provided with a control and regulating device (48), which forms a rotational angle course for a virtual synchronization shaft of the loom and communicates such rotational angle course to respective control and regulating units (49, 51) of each of the drive motors (10, 44), which synchronize the drive motors in at least one angular position relative to the virtual synchronization shaft.

19 Claims, 5 Drawing Sheets

U.S. PATENT DOCUMENTS

| | | | | | |
|---|---|---|---|---|---|
| 5,631,531 | A | * | 5/1997 | Takizawa et al. | 318/560 |
| 5,715,429 | A | * | 2/1998 | Takizawa et al. | 703/7 |
| 5,755,370 | A | * | 5/1998 | Gentile et al. | 226/154 |
| 5,812,432 | A | * | 9/1998 | Takizawa et al. | 703/8 |
| 5,835,915 | A | * | 11/1998 | Carr et al. | 707/202 |
| 5,848,143 | A | * | 12/1998 | Andrews et al. | 379/265.09 |
| 5,859,515 | A | * | 1/1999 | Takizawa et al. | 318/560 |
| 6,186,190 | B1 | | 2/2001 | Verclyte | |
| 6,286,560 | B1 | | 9/2001 | Schwemmlein et al. | |
| 6,525,496 | B1 | | 2/2003 | Bilcke | |
| 6,707,267 | B2 | * | 3/2004 | Bilcke | 318/432 |

FOREIGN PATENT DOCUMENTS

| | | |
|---|---|---|
| EP | 0 893 535 | 1/1999 |
| EP | 0 946 801 | 10/1999 |
| EP | 1 065 306 | 1/2001 |
| FR | 2 660 672 | 10/1991 |
| WO | WO 99/27426 | 6/1999 |

* cited by examiner

METHOD FOR OPERATING A LOOM

BACKGROUND OF THE INVENTION

A. Field

The invention relates to a method for operating a loom, having a first drive motor which drives a first element, such as a batten, and at least a second drive motor which drives a second element, such as a shedding mechanism.

B. Related Art

In looms, the motions of the individual elements must be chronologically adapted to one another. To achieve this chronological adaptation when independent drive motors are used, it is known to detect the rotational angle position of a main shaft, which in particular drives a batten, and to synchronize the drive motor or drive motors of the other elements with these rotational angle positions. This synchronization presents problems, since the main shaft rotational speed changes. Before the beating-up of an inserted weft yarn, the rotational speed of the main shaft decreases. When the batten with the weaving reed reaches the rearward position, the rotational speed of the main shaft increases. If it is a goal to synchronize the drive motor of a shedding mechanism, for instance, with the main drive motor that drives the batten, then the drive motor of the shedding mechanism must likewise perform the nonuniform motion. As a result, the shedding mechanism drive motor, which is already subjected to a heavy load, and the shedding mechanism itself are both subjected to further loads, which are intrinsically not necessary.

To reduce the energy expenditure required for fully synchronous operation, it is known (European Patent Disclosure EP 0893535 A1) to embody the control and regulating device such that a switchover can be made between hard and soft regulation. In hard regulation, which is employed during the starting of the loom, the drive motor of the shedding mechanism follows the main drive motor with very precise synchronization. During normal weaving operation, a switchover to soft regulation is then made, in which mode the drive motor of the shedding mechanism is allowed to lead or trail the main drive motor with slight deviations from synchronized operation.

It is also known (European Patent Disclosure EP 0946801 B1) to control a selvedge tuck-in device of a loom independently of the main drive motor, in accordance with a program. In the process, monitoring is done as to whether desynchronization beyond an allowable value is occurring. If this desynchronization occurs, a correction is made in accordance with a correction program.

It is known to drive all the elements of a loom by means of one common main drive motor. To make it possible to search for a weft yarn if a weft yarn has broken, it is also known (European Patent Disclosure EP 0161012 B1) to provide an additional motor for the search for the weft yarn and for slow motion. In a search for the weft yarn the main drive motor is decoupled, so that by means of the additional motor, either only the shedding means, or the loom, can be moved at low speed.

It is also known (European Patent Disclosure EP 0726345 A1) to design the loom drive such that the same functions, that is, normal weaving operation, searching for a weft yarn, and the slow motion, can all be performed with only a single main drive motor.

It is also known (French Patent Disclosure FR 2660672 A1) to provide a drive motor for the shedding means, in particular a Jacquard mechanism, and a further drive motor for all the other elements of the loom. The two drive motors are connected to one another via an electronic comparator. The electronic comparator constantly compares the information from two pickups, namely one pickup that detects the rotation position of the main shaft of the loom and one pickup that detects the rotation position of the drive motor for the shedding means, and in this way assures that the two motors operate synchronously.

It is the object of the invention to operate a loom of the type defined at the outset such that if at all possible no unnecessary loads have to be overcome by the drive motors for elements.

BRIEF SUMMARY OF THE DISCLOSURE

This object is attained in that a rotational angle course for a virtual synchronization shaft of the loom is established; and that the elements driven by the drive motors are each synchronized, in at least one predetermined rotational angle position, with the virtual synchronization shaft.

The invention proceeds from the concept that the elements of a loom need not be synchronized exactly with one another during the entire weaving cycle, but instead, only in certain rotational angle positions must the individual elements be located in suitable positions. During the rest of the weaving cycle, conversely, they can assume positions that are largely independent of one another. The virtual synchronization shaft is the element in accordance with which not only the additional elements, such as shedding mechanisms or selvedge tuck-in devices, or takeup devices or the like, but also the batten are aligned. The individual elements, including the batten, are thus no longer synchronized with the main shaft but rather with the virtual synchronization shaft, with which the batten is also synchronized. The individual elements can therefore execute their motions such that the least possible loads are imposed on their drive motors and/or the elements themselves, without the course of motion over 360° being adapted to the other elements and in particular to the motion of the batten. The invention offers advantages, particularly upon starting of a loom. A drive motor that drives components of relatively great mass, such as the batten, can be started earlier than a drive motor for a shedding mechanism, for instance. The start times of the drive motors can be adapted such that they, or in other words the elements driven by them, assume whichever rotational angle position is desired at the correct time. For instance, the drive motor of a shedding mechanism can be started such that the warp yarns cross at an angle of 320° of the virtual synchronization shaft, while the drive motor of the batten is started such that the beating-up of a weft yarn occurs at 0° or 360° of the virtual synchronization shaft. Thus it is no longer the time when the drive motors start that is important but instead the fact that the elements driven by them are located in the correct position at the correct time.

In a loom having a first drive motor which drives a first element, such as a batten, and at least a second drive motor which drives a second element, such as a shedding mechanism, the invention is realized in that a control and regulating device is provided, which forms a rotational angle course for a virtual synchronization shaft of the loom and forwards this information to control and regulating units, each assigned to one of the drive motors, which synchronize each of the elements driven by the drive motors, in at least one predetermined rotational angle position, with respect to the virtual synchronization shaft.

In a feature of the invention, it is provided that for each of the shedding means, a separate drive motor is provided, which is independent of a main drive motor that drives the batten.

Since the drive motor of the shedding means is independent of the main drive motor, it can operate under optimized conditions.

In a simple embodiment, which requires virtually no changes to be made in a loom, the drive motor of the shedding means is mounted on a frame of the loom and is connected to the drive elements of the shedding means via a resilient coupling element. The resilient coupling element is appropriate at least in order not to transmit vibration from the shedding means to the other elements of the loom, and vice versa.

In accordance with another feature of the invention, the drive motor of the shedding means is secured to a housing that contains drive elements for the shedding means. Thus the drive motor of the shedding means is maximally separate from the other elements of the loom, so that on the one hand vibration is not mutually transmitted, while on the other hand no deflections of drive forces are necessary.

DESCRIPTION OF THE DRAWINGS

Further characteristics and advantages of the invention will become apparent from the ensuing description of the exemplary embodiments shown in the drawings and from the dependent claims.

DETAILED DESCRIPTION OF THE PREFERRED EMBODIMENTS OF THE INVENTION

Figure 1:
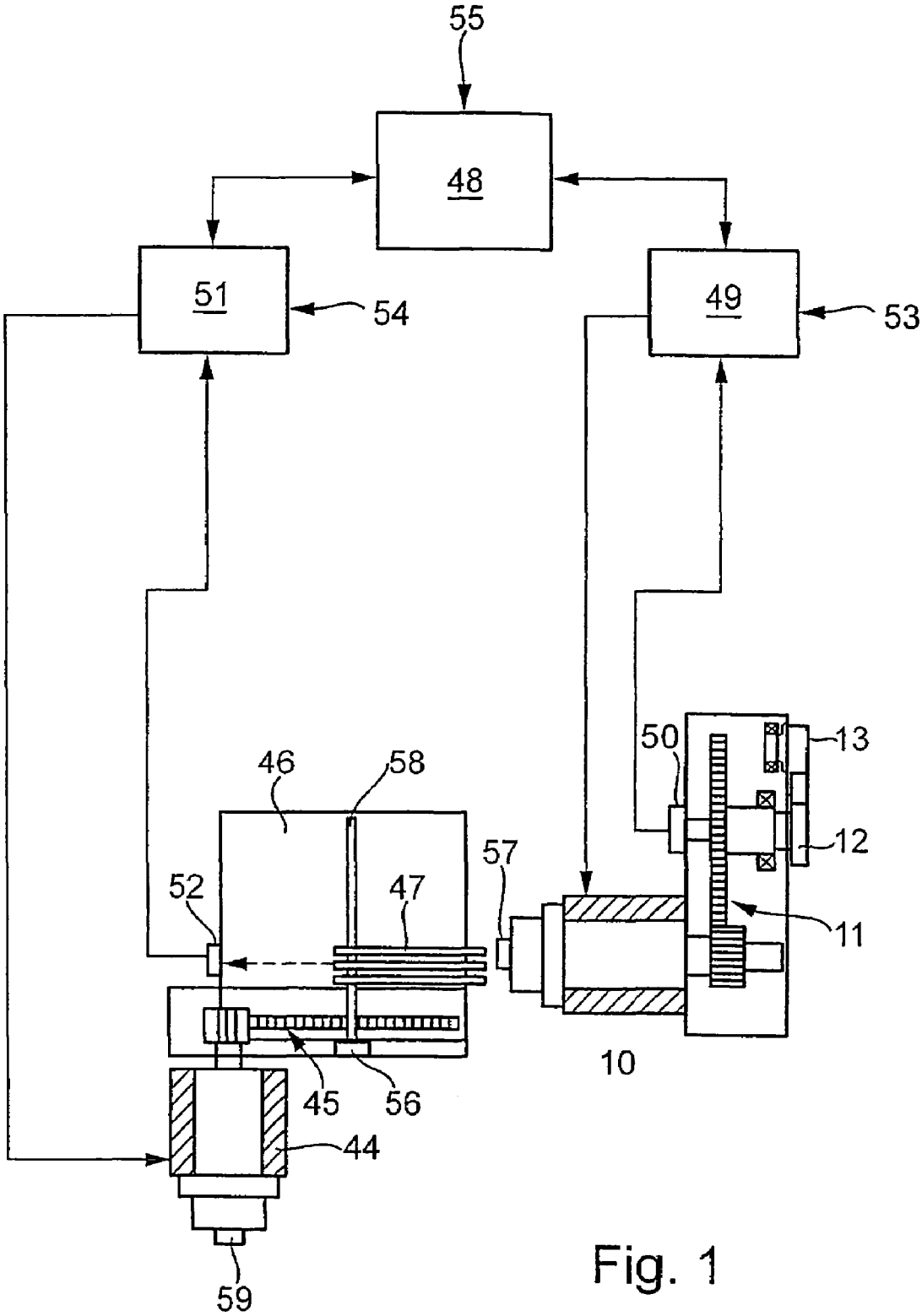
FIG. 1 shows a fragmentary section through a drive of a batten of a loom and a fragmentary section through a drive for a shedding mechanism, as well as a block circuit diagram of the associated control and regulating device.

A first drive motor 10, via a gear stage 11, drives a drive shaft 12 for a batten 13. A second drive motor 44, via a gear stage 45, drives a shedding mechanism 46, embodied for instance as a dobby, which is connected to heddle shafts, not shown, via rod assembly 47.

During one weaving cycle, the shaft 12, which is typically called the main shaft, executes a rotation of 360°. At 0° or 360°, the weaving reed located on the batten 13 beats up an inserted weft yarn. The heddle shafts driven, that is, raised and lowered, by the shedding mechanism 46 and the rod assembly 47, form a shed into which a weft yarn is inserted. After the weft insertion, the shed is changed, by raising and lowering other heddle shafts, after which the next weft yarn is inserted. The change of the shed is done for instance even before the inserted weft yarn has been finally beaten-up. In this process, the warp yarns of the heddle shafts that are moving upward cross with the warp yarns of the heddle shafts that are moving downward. This crossing takes place for instance at an angle of 320° of the shaft 12, or in other words 40° before the beating-up of the inserted weft yarn.

To synchronize the motions of the batten 13 and the shedding mechanism 46, a regulating and control device 48, on the basis of data input by means of an input unit 55, establishes a rotational angle course for a virtual synchronization shaft. The two drive motors 10 and 44 are each driven as a function of the rotational angle of this virtual synchronization shaft. For the drive motor 10 of the batten 13, a control and regulating unit 49 is provided, into which the data are input by means of an input unit 53 for operation as a function of the rotational angle course of the virtual synchronization shaft. A rotational position transducer 50 is connected to the control and regulating unit 49 and senses the position of the shaft 12 and thus the position of the batten 13. In another version, a rotational position transducer 57 is located on the shaft of the drive motor 10. The control and regulating unit 49, which is connected to the drive motor 10, regulates this drive motor 10 in accordance with desired values, which are derived from the rotational angle course of the virtual synchronization shaft, in such a way that the batten 13 is synchronized, for instance in one angular position (0° or 360°), with the virtual synchronization shaft, or in other words upon beating-up of a weft yarn. The control and regulating unit 49 can also specify a program, which in particular corresponds to International Patent Disclosure WO 9927426, for the drive motor 10. The control can then be done in accordance with a predetermined torque or torque course, or a predetermined speed or speed course.

The information about the rotational angle course of the virtual synchronization shaft is also forwarded to a control and regulating unit 51, which is assigned to the drive motor 44. As a function of the rotational angle course of the virtual synchronization shaft, the drive motor 44 is operated in such a way that at a predetermined rotational angle position, such as a rotational angle position of 320° of the virtual synchronization shaft, a defined position is also assumed by the rod assembly 47 of the shedding mechanism 46. An input unit 54, with which the data the operation as a function of the virtual synchronization shaft are input is connected to the control and regulating unit 51. To detect this position, the shedding mechanism 46 has assigned to it a rotational position transducer 52, which is connected to the control and regulating unit 51. It is indicated in the drawing that this rotational position transducer 52 detects the position of the rod assembly 47. However, instead, a rotational position transducer 56 may be located on the shaft 58 of the shedding mechanism 46, or a rotational position transducer 59 may be located on the shaft of the drive motor 44.

Since the drive motors 10 and 44 are completely separate from one another and are not synchronized with each other either, but instead are in relation to one another indirectly via the virtual synchronization shaft, they are can be designed such that they drive the respective associated elements with the least possible expenditure of force. It is also possible to trigger the drive motor 10 of the batten 13 such that during the beating-up of a weft yarn, it always moves the batten at the same speed, or at a speed input by the input unit 53, regardless of the speed of the other elements of the loom, or in other words independently of the weaving speed, which might also vary, with which successive weft yams are woven in. In this way, it can be assured that each weft yam is beaten up with the same or a predetermined different force.

The shedding mechanism for instance includes a heddle shaft machine or an other heddle shaft drive, such as a dobby or cam drive or crank drive or eccentric drive or the like. The shedding mechanism may also be a Jacquard mechanism. The shedding mechanism may furthermore be embodied such that each heddle shaft is assigned an individual drive motor, or groups of heddle shafts are each assigned one drive motor.

The control and regulating device 48 is assigned an input unit 55, by way of which the data that are needed to form the rotational angle course of the virtual synchronization shaft can be input. The control and regulating units 49, 51 of the drive motors 10, 44 are assigned input units 53, 54, by way of which data can be input that determine the angular position or positions of the virtual synchronization shaft with which the drive motors 10, 44 are each synchronized, or in other words the elements driven by them are synchronized.

The drive motors 10, 44 may each be operated with a rotational angle course of their own. The drive motors 10, 44 may be operated, by means of the respective assigned control and regulating unit 49, 51 in conjunction with signals from the rotational position transducers 50, 52, in the manner described for instance in WO 9927426. However, preferably the drive motors 10, 44 are operated, by means of their respective control and regulating units 49, 51, as a function of signals of the control and regulating unit 48 and in this way as a function of the rotational angle course of the virtual synchronization shaft.

Each of the elements, and each of the drive motors 10, 44 need not be synchronized absolutely precisely with a predetermined rotational angle position of the virtual synchronization shaft. It suffices if they are synchronized with these rotational angle positions of the virtual synchronization shaft with a relatively slight tolerance. Synchronization in general is sufficiently precise if the deviation from the rotational angle position of the virtual synchronization shaft is less than 5°. A tolerance value can be defined differently for each weft insertion.

It is understood that each element, for instance the batten, or shedding mechanisms can also be synchronized with a plurality of rotational angle positions of the virtual synchronization shaft. Synchronization for the batten can be synchronized upon beating-up, for instance at 360°, at the beginning of a weft yarn insertion, for instance at 80°, and at the end of a weft yarn insertion, for instance at 240°. In this synchronizing, provision can be made that the batten remains essentially in its rear position, between the rotational angle positions of 80° and 240°. The shedding mechanism can be synchronized for the rotational angle position of the crossing, for instance at 320°, and at the beginning of the weft insertion, for instance at 80°, and at the end of the weft insertion, for instance at 240°, or in other words during the time while the shed has to remain sufficiently widely open.

When the transmission ratio between the drive motor and the driven element is an integer, it is readily possible to synchronize the drive motor, but not the driven element, with rotational angle positions of the virtual synchronization shaft.

The rotational angle course formed for the virtual synchronization shaft can be based on a constant rpm. Preferably, it is provided that the rotational angle course is defined over a plurality of weft insertions and then repeats each time. The rotational angle course can be defined as a function of different types of weft yarns to be inserted in succession, as a function of successive warp yarn bindings, as a function of the number of warp yarns to be moved upward from below or downward from above, or as a function of other conditions. In particular, a suitable rotational angle course for the virtual synchronization shaft will be defined for the starting and stopping of the loom.

It can equally well be provided that the rotational angle positions of the virtual synchronization shaft, with which positions an element is synchronized, can be varied. For instance, if a rotational angle course of the virtual synchronization shaft is defined for a plurality of weft insertions, for instance for three weft insertions, then it can be provided that the shedding mechanism is synchronized for a crossing of the warp yarns at the first weft insertion at 320°, at the second weft insertion at 315°, and a third weft insertion at 310°. After that, the sequence is repeated.

The control or regulation according to the invention of drive motors as a function of the rotational angle course of a virtual synchronization shaft is utilized, as a further feature of the invention, for driving other elements as well, for instance for driving a cloth takeup motor, a motor of a selvedge tuck-in device or a selvedge forming device, or similar devices. Moreover, the invention can also be used to drive a so-called Jacquarette, that is, a small Jacquard mechanism, which controls only a small number of warp yarns, such as 100 warp yarns, while the other warp yarns are controlled by heddle shafts or a large Jacquard mechanism.

Figure 2:
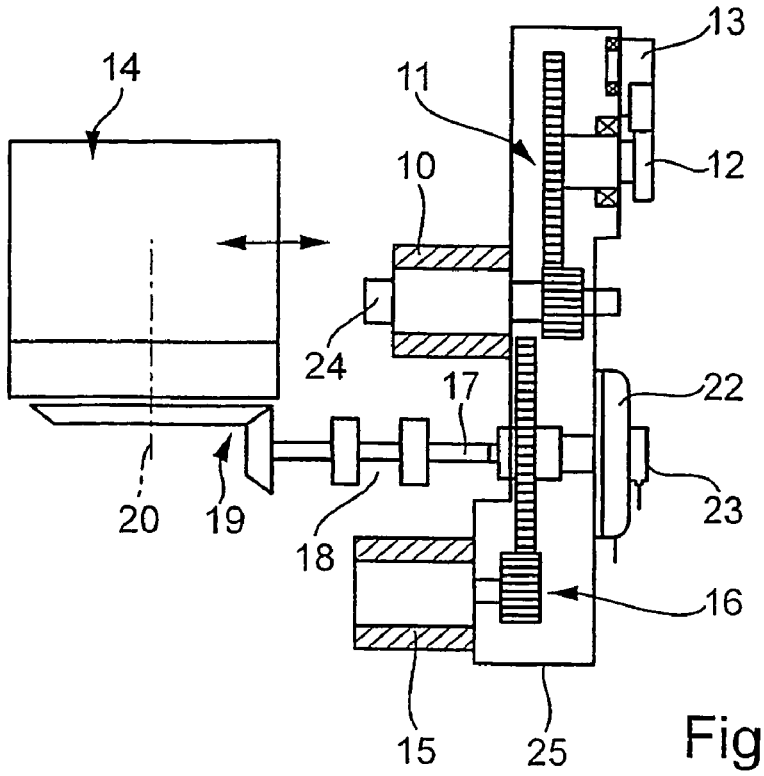
FIG. 2 shows a view partly in section of a first drive with a common gearbox for gear stages of the main drive motor and of the drive motor for the shedding means.

The loom drive shown in part in FIG. 2 includes a main drive motor 10, which via a gear train 11 drives a shaft 12, on which, in a manner not shown in detail, cam disks which drive a batten 13 are located (on both sides of the loom). The main drive motor can drive still other elements, such as a cloth draw-off roller, a sand roller, selvedge tuck-in devices, selvedge rotators, and takeup devices, etc. According to the present invention, for drive elements 14 of the shedding means, which are designed as a dobby or cam drive or crank drive or heddle loom or shaft drive, their own drive motor 15 is provided, which is independent of the main drive motor 10. The drive motor 15, via a gear stage 16, drives a shaft 17, which via an elastic coupling 18, with a bevel gear stage 19, drives the shaft 20 of the drive elements 14. By the rotating motion of the shaft 20, which extends transversely to the shaft of the main drive motor 10, drive means are first driven that execute a reciprocating motion parallel to the shaft of the main drive motor 10. From these drive means, up-and-down motions oriented in the vertical direction are then derived.

In the exemplary embodiment of FIG. 2, a brake 22 and an angular position transducer 23 are provided for the shaft 17. The main drive motor 10 is also assigned an angular position transducer 24. The angular position transducers 23, 24 are connected to the control and regulating unit of the loom in a way corresponding to how the angular position transducers 50, 52 in FIG. 1 are connected to the control and regulating units 48, 49 and 51. The control and regulating units 48, 49 and 51 may be included in the control and regulating unit of the loom. For the main drive motor 10 and the drive motor 15 of the shedding means, they predetermine desired rotary speeds to be regulated. These desired rotary speeds pertain to an rpm of a virtual main shaft, which is defined by the control and regulating unit. Moreover, the main drive motor 10 and the drive motor 15 are each synchronized with at least one angular position of the virtual main shaft, in which position they assume correlated angular positions with the virtual main shaft. For instance, the main drive motor 10 is synchronized with the angular position of 0° (beating-up the weft yarn), while the drive motor 15 is synchronized with 320° (crossing of the warp yarns). The rpm of the main drive motor 10 and of the drive motor 15 are regulated independently of one another to the respective desired values, so that neither of the two drive motors 10 or 15 has to follow the rpm course of the other drive motor.

In the exemplary embodiment of FIG. 2, the gear stages 11 and 16 are accommodated inside a common gearbox 25, which is preferably integrated into a side part of the loom. The main drive motor 10 and the drive motor 15 are located on the same side, that is, on the outside.

Figure 3:
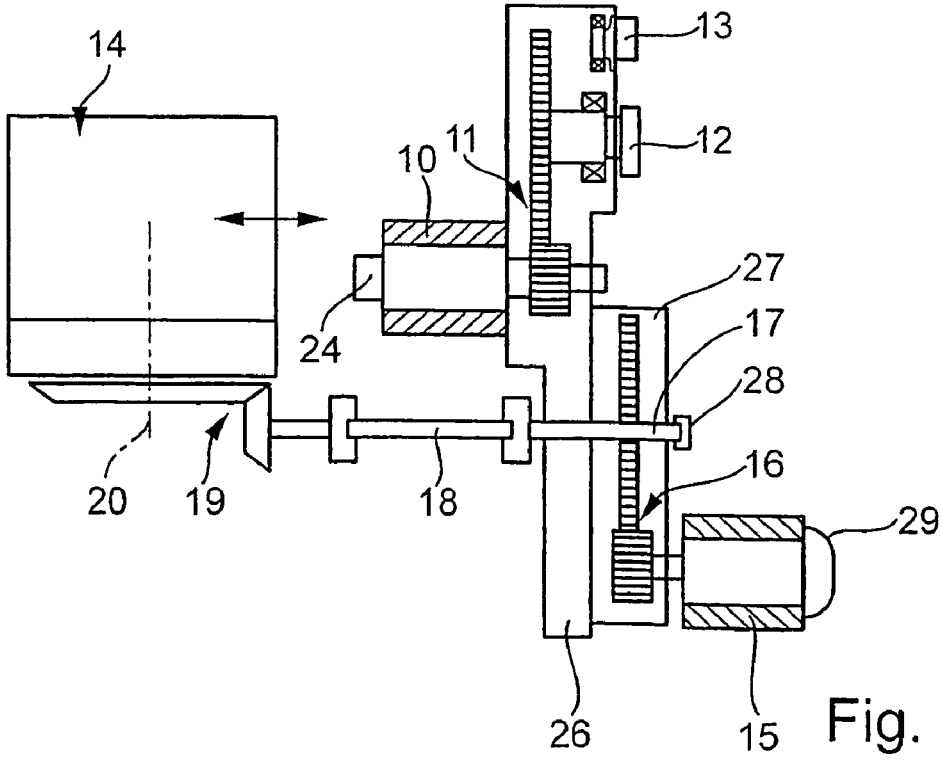
FIG. 3 is a view partly in section similar to FIG. 2, showing an embodiment with separate gear chambers.

In the exemplary embodiment of FIG. 3, the gear train 17 of the drive motor 15 for the drive elements 14 and thus for the shedding means is not accommodated inside the gearbox 26 that contains the gear train 11 of the batten drive. A separate gearbox 27, which contains the gear train 16, is flanged to the gearbox 26. In this exemplary embodiment, the drive motor 15 of the shedding means is located on the side diametrically opposite the main drive motor 10. In this embodiment an angle transmitter or rpm transmitter is assigned to the shaft. A brake may be integrated into the drive motor 15.

Figure 4:
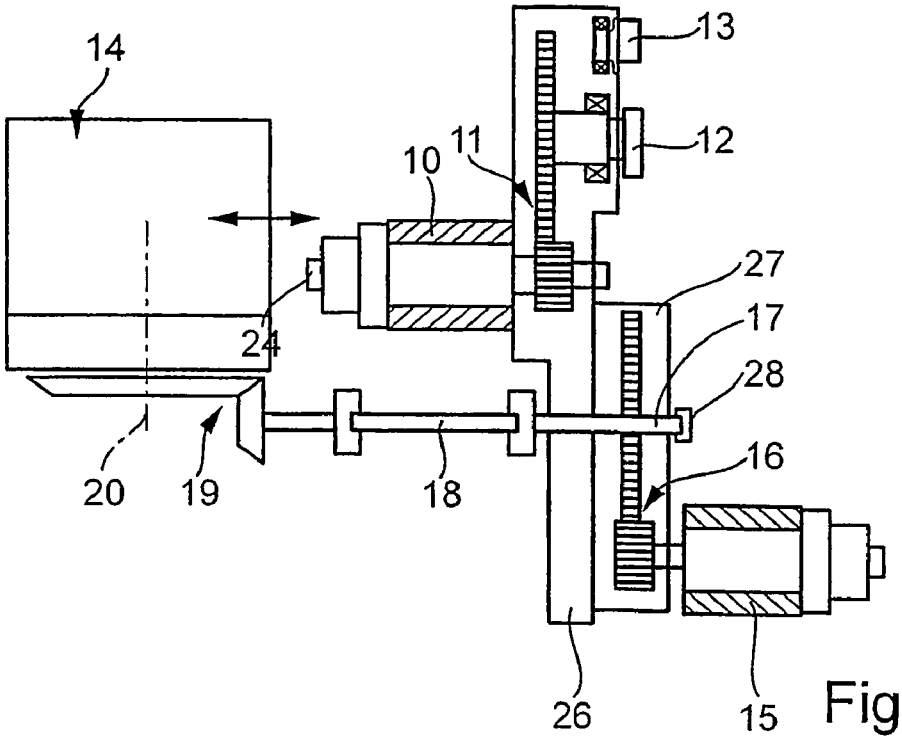
FIG. 4 is a view partly in section similar to FIG. 3 showing an embodiment that is equipped with additional elements.

The embodiment of FIG. 4 corresponds in its basic layout to the embodiment of FIG. 3. In addition, a brake 29 and further angular position transducer or rpm transducer 31 are assigned to the drive motor 15 of the shedding means. In addition, the main drive motor 10 is also equipped with a brake 30.

Figure 5:
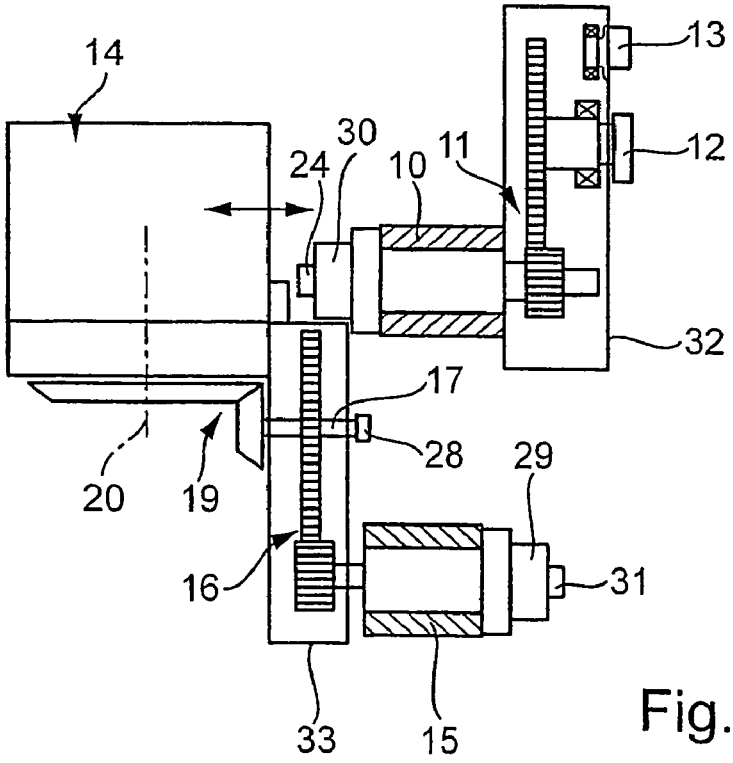
FIG. 5 is a view partly in section of an embodiment with a main drive motor and a drive motor for the shedding means that have gears with separate gearboxes.

In the embodiment of FIG. 5, the gearbox 32 of the main drive is completely separate from a gearbox 33 of the drive for the drive elements 14. The gearbox 33, which contains the gear stage 16 and to which the drive motor 15 is flanged, is secured to the housing of the drive elements 14. The gear stage 16 is connected directly to the bevel gear train 19, or in other words without the interposition of a resilient coupling. In this embodiment, the drive motor 15 of the shedding means is located such that its axis extends parallel to the axis of the main drive motor 10. Since the gearbox 33 is completely separate from the gearbox 32 of the gear train 11 of the main drive motor 10, it is naturally also readily possible to mount the gearbox 33 with the drive motor 15 above or below or on the diametrically opposite side of the housing of the drive elements 14.

Figure 6:
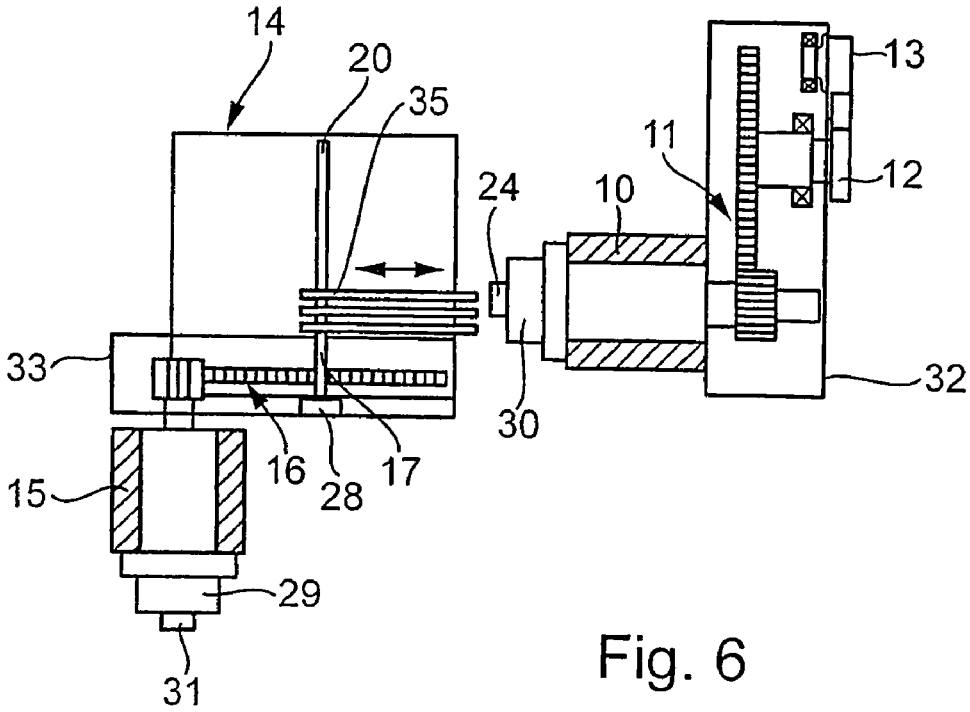
FIG. 6 is a view partly in section of an embodiment in which the drive motor of the shedding means is mounted via a gear on a housing for drive elements.

In the embodiment of FIG. 6, the drive motor 15 for the drive elements 14 and thus for the shedding means is likewise completely separate from the rest of the loom. The gear train 16 is located in the gearbox 33, which is flanged to the housing of the drive elements 14 in such a way that the shaft 17 extends coaxially to the shaft 20, which causes reciprocating linear motions parallel to the axis of the main drive motor 10. The gearbox 33 with the drive motor 15 flanged to it is located, in a modified embodiment, on the diametrically opposite side of the drive elements 14.

Figure 7:
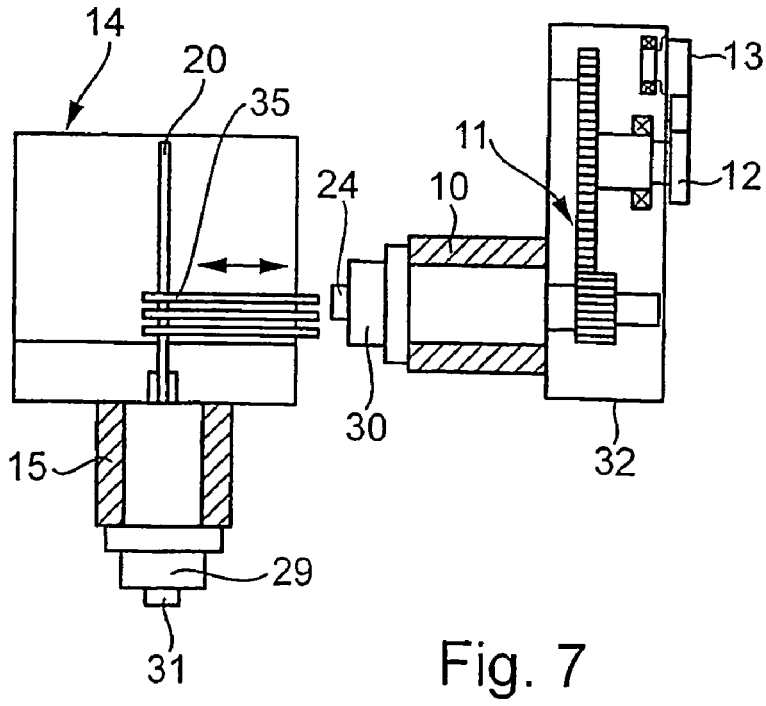
FIG. 7 is a view partly in section of an embodiment in which the drive motor of the shedding means is mounted directly on a housing for drive elements.

In the embodiment of FIG. 7, the drive motor 15 for the drive elements 14 and thus for the shedding means is flanged directly to the housing of the drive elements 14, in such a way that the axis of the drive motor 15 extends coaxially with the shaft 20 of the drive elements 14.

Figure 8:
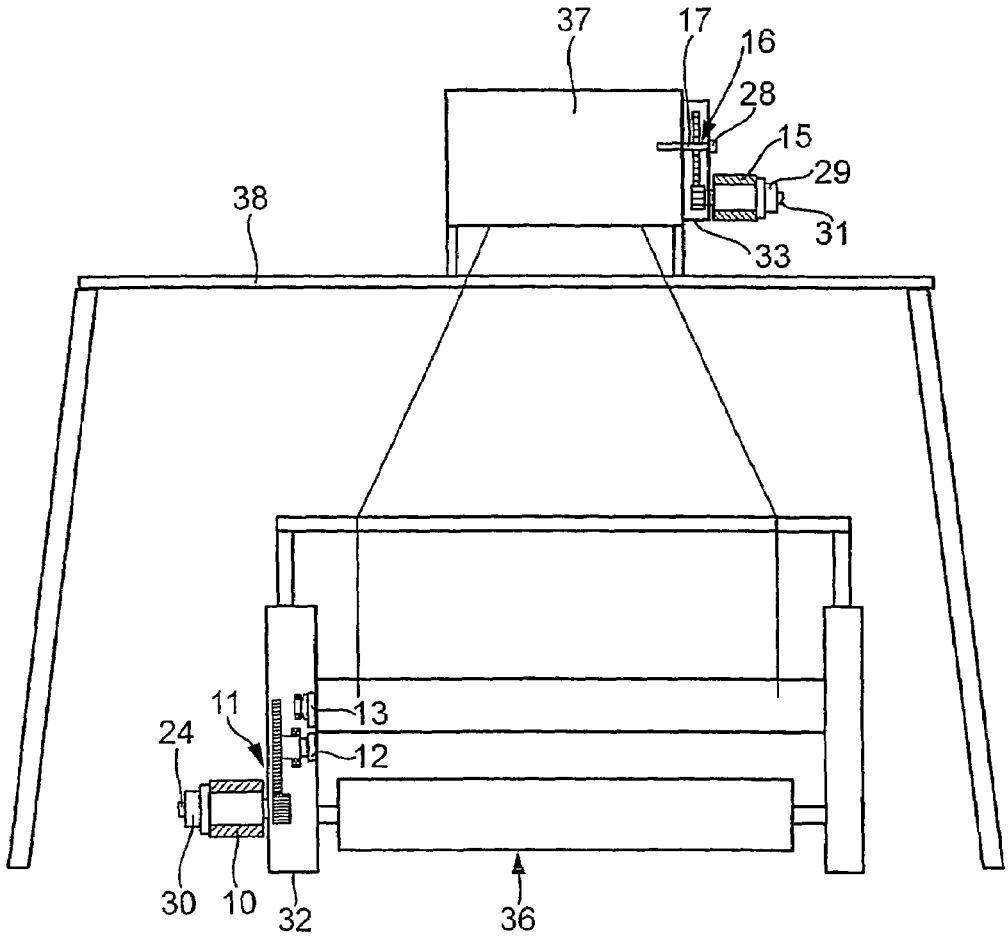
FIG. 8 is a view partly in section of a loom with a Jacquard mechanism that has its own drive motor.

The concept of the present invention, namely to provide a drive motor for shedding means that is drivable independently of a main drive motor 10 of a loom, is realized in the embodiment of FIG. 8 for a loom 36 which is equipped with a Jacquard mechanism 37. The loom 36 has a main drive motor 10, which via a gear stage drives a shaft 12, which is provided with a cam, for a batten 13. The gear train 11 is accommodated in a gearbox 32 that is integrated with a side part of the loom. The Jacquard mechanism 37, located on a frame 38 above the loom 36, is provided with its own drive motor 15. In this exemplary embodiment, the drive motor 15 is flanged to a gearbox 33. The power takeoff shaft 17 of the gear stage 16 is coupled preferably directly to the shaft of the Jacquard mechanism 37, or in other words is located coaxially with it. In a modified embodiment, a gearbox 33 is dispensed with, since the gear stage 16 is integrated directly with the Jacquard mechanism 37. In a further-modified embodiment, the drive motor 15 is connected directly to the Jacquard mechanism 37, that is, without a gear train.

Since there is no mechanical connection between the main drive motor 10 and the drive motor 15 for the drive elements of the shedding means, the various locations that are most favorably spaced can be selected, both for a Jacquard mechanism 37 and for shaft drives. Both the shaft drive and a Jacquard mechanism 17 may, together with the respective drive motor 15, form a prefabricated structural unit that is assigned to the applicable loom.

The invention claimed is:

1. A method for operating a loom having a first drive motor which drives a first loom element and at least a second drive motor which drives a second loom element, said motors each having a control and regulation unit associated therewith, comprising forming a rotational angle course for a virtual synchronization shaft of the loom; and synchronizing the elements driven by the drive motors so that the elements are synchronized with the virtual synchronization shaft at one or more predefined angular positions only, and are driven by the drive motors independently of each other irrespective of synchronization with each other and the virtual synchronization shaft at positions other than said one or more predetermined angular positions by operating the drive motors independently of each other at the other positions.

2. The method according to claim 1, wherein the drive motors are operated as a function of the rotational angle course of the virtual synchronization shaft.

3. The method according to claim 1, wherein the rotary motion of at least one of the drive motors is regulated; and wherein the regulation is based on desired values which are derived from the rotational angle course of the virtual synchronization shaft.

4. The method according to claim 1, wherein the rotary motion of at least one of the drive motors is controlled in accordance with a program.

5. The method according to claim 1, wherein the angular positions of the virtual synchronization shaft with which the drive motors are synchronized are adjustable.

6. A loom having a first drive motor which drives a first loom element and at least a second drive motor which drives a second loom element, comprising a control and regulating device which is arranged to form a rotational angle course for a virtual synchronization shaft of the loom and to communicate signals related to such rotational angle course to respective control and regulating units of each of the drive motors, which are arranged to synchronize each of the elements driven by the drive motors in at least one predetermined rotational angle position with the virtual synchronization shaft on the basis of such signals in a manner such that the elements are synchronized with the virtual synchronization shaft at said at least one predetermined rotational angle position, and to drive the respective drive motors independently of each other irrespective of synchronization with each other and the virtual synchronization shaft at positions other than said at least one predetermined rotational angle position.

7. The loom according to claim 6, wherein the control and regulating unit of at least one of the drive motors regulates the rotary motion of said one drive motor in accordance with desired values that are derived from the rotational angle course of the virtual synchronization shaft.

8. The loom according to claim 6 wherein the control and regulating unit of at least one of the drive motors includes a program controller.

9. The loom according to claim 6, wherein the control and regulating units of the drive motors are assigned input devices by means of which data can be input, and on the basis of which data the angular positions to be synchronized with the virtual synchronization shaft are adjustable.

10. The loom according to claim 6, wherein the first and second loom elements include a shedding mechanism and a batten respectively, and wherein the first and second drive motors are independent of each other, said second drive motor comprising a loom main drive motor.

11. The loom according to claim 10, wherein the first drive motor is mounted on a frame of the loom and is connected to the shedding mechanism via a resilient coupling element.

12. The loom according to claim 10, wherein at least one gear train is provided between the batten and the main drive motor and between drive elements of the shedding mechanism and the first drive motor.

13. The loom according to claim 10, wherein a gear train associated with the main drive motor and a gear train associated with the second drive motor are located in a common gearbox.

14. The loom according to claim 13, wherein the gear train associated with the main drive motor and the gear train associated with the second drive motor are accommodated in chambers separate from one another in the common gearbox.

15. The loom according to claim 10, wherein the second drive motor is secured to a housing that contains drive elements for the shedding mechanism.

16. The loom according to claim 15, wherein the second drive motor is secured to a gearbox which in turn is secured to a housing of the drive elements of the shedding mechanism.

17. The loom according to claim 15, wherein the second drive motor is mounted directly on a housing of the drive elements of the shedding mechanism.

18. The loom according to claim 6, wherein the main drive motor and a loom component comprising at least one of the batten, the second drive motor, the drive elements, and the shedding mechanism is assigned a sensor which is arranged to detect the angular position of the respective component.

19. The loom according to claim 6, wherein the first and second loom elements comprise a batten and a shedding mechanism, respectively, wherein said first drive motor is a loom main drive motor and further wherein at least one of the main drive motor and the second drive motor is assigned a switchable brake.

* * * * *